US005811081A

United States Patent [19]

Fuso et al.

[11] Patent Number: 5,811,081

[45] Date of Patent: Sep. 22, 1998

[54] USE OF HYDROXYBENZOTRIAZOLES FOR ENHANCING THE SUN PROTECTION FACTOR OF CELLULOSIC FIBRE MATERIALS

[75] Inventors: Francesco Fuso, Therwil; Gerhard Reinert, Allschwil, both of Switzerland

[73] Assignee: Ciba Specialty Chemicals Corporation, Tarrytown, N.Y.

[21] Appl. No.: 534,523

[22] Filed: Sep. 27, 1995

[51] Int. Cl.[6] ..... A61K 7/42; B32B 7/08

[52] U.S. Cl. ..... 424/59; 428/224; 428/289

[58] Field of Search ..... 424/59; 428/224, 428/289

[56] References Cited

FOREIGN PATENT DOCUMENTS

| | | |
|---|---|---|
| 0388356 | 9/1990 | European Pat. Off. . |
| A3239757 | 10/1991 | Japan . |
| A3241069 | 10/1991 | Japan . |
| 94/04515 | 3/1994 | WIPO . |

OTHER PUBLICATIONS

Chem. Abstract, 116, 108247p Oct. 25, 1991.
Chem. Abstract, 116, 1537725 Oct. 28, 1991.

*Primary Examiner*—Shelley A. Dodson
*Assistant Examiner*—Michael A. Williamson
*Attorney, Agent, or Firm*—David R. Crichton; Kevin T. Mansfield

[57] ABSTRACT

The invention relates to the use of the compound of formula

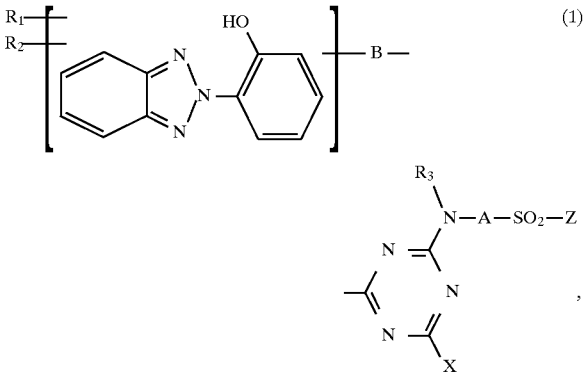

(1)

wherein the variables are as defined in the claims, for enhancing the sn protection factor of cellulosic fiber materials.

21 Claims, No Drawings

USE OF HYDROXYBENZOTRIAZOLES FOR ENHANCING THE SUN PROTECTION FACTOR OF CELLULOSIC FIBRE MATERIALS

The present invention relates to the use of hydroxybenzotriazoles for enhancing the sun protection factor of cellulosic fibre materials by treating said materials with specific compounds of the class of hydroxybenzotriazoles.

It has long been common knowledge that UV radiation is harmful to the human skin and people have accordingly also been concerned to protect themselves from the effects of excessive solar radiation. The most commonly employed methods of protection are the use of a sun cream or wearing clothes. Whereas the use of sun cream virtually only comes into contention for the bare skin and is mainly applied when one is engaged in leisure pursuits or in sporting activities, the usual means of protecting the human body from solar radiation is the wearing of clothes. It has been found, however, that the wearing of an article of clothing alone, especially the white or light-coloured T-shirt worn for preference in the summer months, does not always ensure adequate sun protection.

A process for enhancing the sun protection factor of textile materials and fabrics by treating them with UV absorbers is taught in WO/94/04515. It has been found, however, that the enhancement of the sun protection factor thereby achieved does not meet the requirements in all respects.

Hence there is a continuing need to improve the sun protection factor of textile materials.

Surprisingly, it has been found that a still greater solar protection can be achieved by treating cellulosic fabrics with specific hydroxybenzotriazoles.

Accordingly, the invention relates to the use of compounds of formula

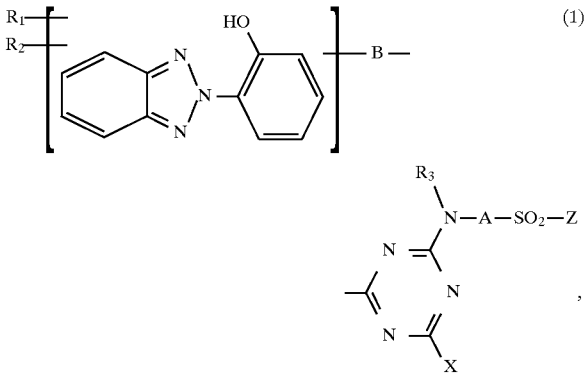

(1)

wherein $R_1$ and $R_2$ are each independently of the other hydrogen, $C_1$–$C_4$alkyl; $C_1$–$C_4$alkoxy; halogen; hydroxy; nitro; sulfo or carboxy;

$R_3$ is hydrogen; or $C_1$–$C_4$alkyl which is unsubstituted or substituted by $C_1$–$C_4$alkoxy, halogen, hydroxy, sulfo, cyano, carboxy, $C_1$–$C_4$alkoxycarbonyl, $C_1$–$C_4$alkylcarbonyloxy, carbamoyl or sulfamoyl;

A is phenylene which is unsubstituted or substituted by $C_1$–$C_4$alkyl, $C_1$–$C_4$alkoxy, halogen or sulfo; naphthylene which is unsubstituted or substituted by $C_1$–$C_4$alkyl, $C_1$–$C_4$alkoxy, halogen or sulfo, or $C_1$–$C_{12}$alkylene which is unsubstituted or substituted by halogen, hydroxy, sulfato, cyano, carboxy, $C_1$–$C_5$alkoxycarbonyl, $C_1$–$C_4$alkanoyloxy or carbamoyl, and in which the alkylene chain is interrupted from $C_2$ by oxygen or —NR'—, wherein R' is hydrogen or $C_1$–$C_6$alkyl, and may be branched from $C_3$, and R' is able to form a ring together with the alkylene chain;

B is oxygen; a radical —N($R_4$)—, wherein $R_4$ is hydrogen or $C_1$–$C_4$alkyl, or a radical —$(CH_2)_n$—NH— which is attached at the triazine radical through the nitrogen atom, and in which n is 1 to 4;

X is chloro; fluoro; pyridyl which is unsubstituted or substituted by halogen, sulfo, carboxy, carbamoyl or $C_1$–$C_4$alkyl which is unsubstituted or substituted by hydroxy or sulfo; a radical —$NR_5R_6$, wherein $R_5$and $R_6$ are each independently of the other hydrogen, $C_1$–$C_4$alkyl which is unsubstituted or substituted by $C_1$–$C_4$alkoxy, chloro, hydroxy, sulfo, sulfato, carboxy or phenyl; phenyl which is unsubstituted or substituted by $C_1$–$C_4$alkyl, $C_1$–$C_4$alkoxy, halogen, sulfo or carboxy; naphthyl which is unsubstituted or substituted by $C_1$–$C_4$alkyl, $C_1$–$C_4$alkoxy, chloro, hydroxy, sulfo or carboxy; or benzyl which is unsubstituted or substituted in the phenyl ring by $C_1$–$C_4$alkyl, $C_1$-$C_4$alkoxy, chloro or sulfo; or a radical –$OR_7$, wherein $R_7$ is hydrogen, $C_1$–$C_4$alkyl which is unsubstituted or substituted by $C_1$–$C_4$alkoxy, chloro, hydroxy, sulfo, sulfato, carboxy or phenyl; phenyl which is unsubstituted or substituted by $C_1$–$C_4$alkyl, $C_1$–$C_4$alkoxy, halogen, sulfo or carboxy; naphthyl which is unsubstituted or substituted by $C_1$-$C_4$alkyl, $C_1$–$C_4$ alkoxy, chloro, hydroxy, sulfo or carboxy; or benzyl which is unsubstituted or substituted in the phenyl ring by $C_1$–$C_4$ alkyl, $C_1$–$C_4$ alkoxy, chloro or sulfo; and Z is β-haloethyl, β-sulfatoethyl, β-thiosulfatoethyl, β-phosphatoethyl, β-acetoxyethyl or vinyl;

for enhancing the sun protection facor of cellulosic fabrics.

$R_1$, $R_2$, $R_3$, $R_4$, $R_5$, $R_6$ and $R_7$ defined as $C_1$–$C_4$ alkyl are each independently of the other methyl, ethyl, n-propyl, isopropyl, n-butyl, isobutyl, sec-butyl or tert-butyl.

$R_1$ and $R_2$ defined as $C_1$–$C_4$ alkoxy may each independently of the other be methoxy, ethoxy, propoxy, isopropoxy, isobutoxy or tert-butoxy.

$R_1$ and $R_2$ defined as halogen may each independently of the other be fluoro, chloro or bromo.

$R_3$, $R_5$, $R_6$ and $R_7$ defined as $C_1$–$C_4$alkoxy-$C_1$–$C_4$alkyl are each independently of the other typically methoxymethyl, ethoxymethyl, 2-methoxyethyl, 2-ethoxyethyl, 3-methoxypropyl or 3-ethoxypropyl.

$R_3$ defined as halo-$C_1$–$C_4$alkyl will typically be chloromethyl, chloroethyl, 2-chloroethyl, 2-bromoethyl, 3-chloropropyl, 3-bromopropyl, 4-chlorobutyl or 4-bromobutyl.

$R_3$, $R_5$, $R_6$ and $R_7$ defined as hydroxy-$C_1$–$C_4$alkyl will each independently of the other typically be 2-hydroxyethyl, 2-hydroxypropyl, 3-hydroxypropyl, 2-hydroxybutyl, 3-hydroxybutyl, 4-hydroxybutyl, 2,3-dihydroxypropyl or 3,4-dihydroxybutyl.

$R_3$, $R_5$, $R_6$ and $R_7$ defined as sulfo-$C_1$–$C_4$alkyl are each independently of the other typically sulfomethyl, 2-sulfoethyl, 3-sulfopropyl or 4-sulfobutyl.

$R_3$ defined as cyano-$C_1$–$C_4$alkyl is typically cyanomethyl, 2-cyanoethyl or 3-cyanopropyl.

$R_3$, $R_5$, $R_6$ and $R_7$ defined as carboxy-$C_1$–$C_4$alkyl are each independently of the other typically carboxymethyl, 2-carboxyethyl, 3-carboxypropyl, 4-carboxybutyl or 1,2-dicarboxyethyl.

$R_3$ defined as $C_1$–$C_4$alkoxycarbonyl-$C_1$–$C_4$alkyl will typically be methoxycarbonylmethyl, ethoxycarbonylmethyl, 2-methoxycarbonylethyl, 2-ethoxycarbonylethyl, 3-methoxycarbonylpropyl, 3-ethoxycarbonylpropyl, 4-methoxycarbonylbutyl or 4-ethoxycarbonylbutyl.

$R_3$ defined as $C_1$–$C_4$alkylcarbonyloxy-$C_1$–$C_4$alkyl will typically be methylcarbonyloxymethyl, ethylcarbonyloxymethyl, 2-methylcarbonyloxyethyl, 2-ethylcarbonyloxyethyl, 3-methylcarbonyloxypropyl, 3-ethylcarbonyloxypropyl, 4-methylcarbonyloxybutyl or 4-ethylcarbonyloxybutyl.

$R_3$ defined as carbamoyl-$C_1$–$C_4$alkyl will typically be carbamoylmethyl, 2-carbamoylethyl, 3-carbamoylpropyl or 4-carbamoylbutyl.

$R_3$ defined as sulfamoyl-$C_1$–$C_4$alkyl will typically be sulfamoylmethyl, 2-sulfamoylethyl, 3-sulfamoylpropyl or 4-sulfamoylbutyl.

$R_5$, $R_6$ and $R_7$ defined as $C_1$–$C_4$alkylphenyl are each independently of the other typically tolyl, xylyl, mesityl, cumyl, ethylphenyl or butylphenyl.

$R_5$, $R_6$ and $R_7$ defined as $C_1$–$C_4$alkoxyphenyl are each independently of the other typically methoxyphenyl, ethoxyphenyl, propoxyphenyl or butoxyphenyl.

$R_5$, $R_6$ and $R_7$ defined as halophenyl are each independently of the other typically chlorophenyl or bromophenyl.

$R_5$, $R_6$ and $R_7$ defined as $C_1$–$C_4$alkylnaphthyl are each independently of the other typically methylnapthyl, ethylnapthyl, propylnapthyl or butylnapthyl.

$R_5$, $R_6$ and $R_7$ defined as $C_1$–$C_4$alkoxynaphthyl are each independently of the other typically methoxynapthyl, ethoxynapthyl, propoxynapthyl or butoxynapthyl.

$R_5$, $R_6$ and $R_7$ defined as $C_1$–$C_4$alkylbenzyl are each independently of the other typically methylbenzyl, ethylbenzyl, propylbenzyl or butylbenzyl.

$R_5$, $R_6$ and $R_7$ defined as $C_1$–$C_4$alkoxybenzyl are each independently of the other typically methoxybenzyl, ethoxybenzyl, propoxybenzyl or butoxybenzyl.

R' defined as $C_1$–$C_6$alkyl is typically methyl, ethyl, propyl, isopropyl, butyl, isobutyl, sec-butyl, tert-butyl, pentyl or hexyl.

A in the significance of $C_1$–$C_4$alkylphenylene may be exemplified by tolylene, xylylene, mesitylene, cumylen, ethylphenylene or butylphenylene.

A in the significance of $C_1$–$C_4$alkoxyphenyl may be exemplified by methoxyphenylene, ethoxyphenylene, propoxyphenylene or butoxyphenylene.

A in the significance of halophenylene may be exemplified by chlorophenylene or bromophenylene.

A in the significance of $C_1$–$C_4$alkylnaphthylene may be exemplified by methylnapthylene, ethylnapthylene, propylnapthylene or butylnapthylene.

A in the significance of $C_1$–$C_4$alkoxynaphthylene may be exemplified by methoxynapthylene, ethoxynapthylene, propoxynapthylene or butoxynapthylene.

A in the significance of $C_1$–$C_{12}$alkylene may be exemplified by methylene, ethylene, propylene, tetramethylene, pentamethylene or hexamethylene.

A in the significance of substituted phenylene may carry one or more than one of the cited substituents.

A in the significance of substituted naphthylene may carry one or more than one of the cited substituents.

Where $R_5$, $R_6$ or $R_7$ represent a substituted phenyl radical, said radical may be substituted by one or more than one of the cited substituents.

Where $R_5$, $R_6$ or $R_7$ represent a substituted naphthyl radical, said radical may be substituted by one or more than one of the cited substituents.

Where $R_5$, $R_6$ or $R_7$ represent substituted benzyl, the benzyl radical in the phenyl ring may be substituted by one or more than one of the cited substituents.

Preferred embodiments of the novel utility comprise:

(a) The use of compounds of formula (1), wherein $R_1$ is hydrogen, methyl, ethyl, propyl, isopropyl, methoxy, ethoxy, chloro, hydroxy, sulfo or carboxy.

(b) The use of compounds of formula (1), wherein $R_2$ is hydrogen, methyl, ethyl, propyl, isopropyl, methoxy, ethoxy, chloro, hydroxy, sulfo or carboxy.

(c) The use of compounds of formula (1), wherein X is the radical —$NR_5R_6$, wherein $R_5$ and $R_6$ are each independently of the other hydrogen; $C_1$–$C_4$alkyl which is unsubstituted or substituted by $C_1$–$C_4$alkoxy, chloro, hydroxy, sulfo, sulfato, carboxy or phenyl; phenyl which is unsubstituted or substituted by $C_1$–$C_4$alkyl, $C_1$–$C_4$alkoxy, halogen, sulfo or carboxy; naphthyl which is unsubstituted or substituted by $C_1$–$C_4$alkyl, $C_1$–$C_4$alkoxy, chloro, hydroxy, sulfo or carboxy; or benzyl which is unsubstituted or substituted in the phenyl ring by $C_1$–$C_4$alkyl, $C_1$–$C_4$alkoxy, chloro or sulfo.

(d) The use of compounds of formula (1), wherein X is the radical —$NR_5R_6$, wherein $R_5$ is hydrogen, methyl, ethyl, propyl, isopropyl, butyl, isobutyl, sec-butyl, β-methoxyethyl, β-hydroxyethyl, β-sulfoethyl, β-sulfatoethyl or β-carboxyethyl, and $R_6$ has the meaning previously assigned to it.

(e) The use of compounds of formula (1), wherein X is the radical —$NR_5R_6$, wherein $R_5$ is phenyl, 2-sulfophenyl, 3-sulfophenyl, 4-sulfophenyl, 2,4-disulfophenyl, 2,5-disulfophenyl, 2-carboxyphenyl, 3-carboxyphenyl or 4-carboxyphenyl, and $R_6$ has the meaning previously assigned to it.

(f) The use of compounds of formula (1), wherein X is the radical —$NR_5R_6$, wherein $R_5$ is 2-sulfo-1-naphthyl, 3-sulfo-1-naphthyl, 4-sulfo-1-naphthyl, 5-sulfo-1-naphthyl, 6-sulfo-1-naphthyl, 7-sulfo-1-naphthyl, 8-sulfo-1-naphthyl, 1-sulfo-2-naphthyl, 5-sulfo-2-naphthyl, 6-sulfo-2-naphthyl, 7-sulfo-2-naphthyl, 8-sulfo-2-naphthyl, 1,5-disulfo-2-naphthyl, 5,7-disulfo-2-naphthyl, 6,8-disulfo-2-naphthyl, 4,8-disulfo-2-naphthyl, 4,7-disulfo-2-naphthyl, 3,8-disulfo-2-naphthyl, 4,6-disulfo-2-naphthyl, 3,7-disulfo-2-naphthyl, 3,6-disulfo-2-naphthyl, 4,6,8-trisulfo-1-naphthyl, 2,4,7-trisulfo-1-naphthyl, 3,6,8-trisulfo-1-naphthyl, 4,6,8-trisulfo-2-naphthyl, 1,5,7-trisulfo-2-naphthyl or 3,6,8-trisulfo-2-naphthyl, and $R_6$ has the significance previously assigned to it.

(g) The use of compounds of formula (1), wherein X is the radical —$NR_5R_6$, wherein $R_5$ is benzyl, 2-sulfobenzyl, 3-sulfobenzyl or 4-sulfobenzyl, and $R_6$ has the meaning previously assigned to it.

(h) The use of compounds of formula (1), wherein X is the radical —$NR_5R_6$, wherein $R_6$ is hydrogen, methyl, ethyl, propyl, isopropyl, butyl, isobutyl, sec-butyl, β-methoxyethyl, β-hydroxyethyl, β-sulfoethyl, β-sulfatoethyl or β-carboxyethyl, and $R_5$ has the meanings and preferred meanings previously assigned to it.

(i) The use of compounds of formula (1), wherein X is the radical —$NR_5R_6$, wherein $R_6$ is phenyl, 2-sulfophenyl, 3-sulfophenyl, 4-sulfophenyl, 2,4-disulfophenyl, 2,5-disulfophenyl, 2-carboxyphenyl, 3-carboxyphenyl or 4-carboxyphenyl, and $R_5$ has the meanings and preferred meanings previously assigned to it.

(j) The use of compounds of formula (1), wherein X is the radical —$NR_5R_6$, wherein $R_6$ is 2-sulfo-1-naphthyl, 3-sulfo-1-naphthyl, 4-sulfo-1-naphthyl, 5-sulfo-1-naphthyl, 6-sulfo-1-naphthyl, 7-sulfo-1-naphthyl, 8-sulfo-1-naphthyl, 1-sulfo-2-naphthyl, 5-sulfo-2-naphthyl, 6-Sulfo-2-naphthyl, 7-sulfo-2-naphthyl, 8-sulfo-2-naphthyl, 1,5-disulfo-2-naphthyl, 5,7-disulfo-2-naphthyl, 6,8-disulfo-2-naphthyl, 4,8-disulfo-2-naphthyl, 4,7-disulfo-2-naphthyl, 3,8-disulfo-2-naphthyl, 4,6-disulfo-2-naphthyl, 3,7-disulfo-2-naphthyl, 3,6-disulfo-2-naphthyl, 4,6,8-trisulfo-1-naphthyl, 2,4,7-trisulfo-1-naphthyl, 3,6,8-trisulfo-1-naphthyl, 4,6,8-trisulfo-2-naphthyl, 1,5,7-trisulfo-2-naphthyl or 3,6,8-trisulfo-2-naphthyl, and $R_5$ has the meanings and preferred meanings previously assigned to it.

(k) The use of compounds of formula (1), wherein X is the radical —$NR_5R_6$, wherein $R_6$ is benzyl, 2-sulfobenzyl, 3-sulfobenzyl or 4-sulfobenzyl, and $R_5$ has the meanings and preferred meanings previously assigned to it.

(l) The use of compounds of formula (1), wherein X is the radical —$NR_5R_6$, wherein one of the substituents $R_5$ and $R_6$ is $C_1$–$C_4$alkyl which is unsubstituted or substituted by $C_1$–$C_4$alkoxy, chloro, hydroxy, sulfo, sulfato, carboxy or phenyl; phenyl which is unsubstituted or substituted by $C_1$–$C_4$alkyl, $C_1$–$C_4$alkoxy, halogen, sulfo or carboxy; naphthyl which is unsubstituted or substituted by $C_1$–$C_4$alkyl, $C_1$–$C_4$alkoxy, chloro, hydroxy, sulfo or carboxy; or benzyl which is unsubstituted or substituted in the phenyl ring $C_1$–$C_4$alkyl, $C_1$–$C_4$alkoxy, chloro or sulfo, and the other substituent $R_5$ or $R_6$ is hydrogen, methyl or ethyl.

(m) The use of compounds of formula (1), wherein A is phenylene which is unsubstituted or substituted by $C_1$–$C_4$alkyl, $C_1$–$C_4$alkoxy, halogen or sulfo.

(n) The use of compounds of formula (1), wherein A is the group —$(CH_2)_a$—NH—$(CH_2)_b$—, wherein a is an integer from 1 to 6 and b is an integer from 1 to 6.

(o) The use of compounds of formula (1), wherein Z is the radical —$CH_2CH_2OSO_3H$.

(p) The use of compounds of formula (1), wherein X is pyridyl, 3-methylpyridyl, 3-β-hydroxyethylpyridyl, 4-β-sulfoethylpyridyl, 4-chloropyridyl, 3-sulfopyridyl, 2-carboxypyridyl, 3,5-dicarboxypyridyl or 2-carbamoylpyridyl, 3-carbamoylpyridyl, 4-carbamoylpyridyl, preferably 3-carboxypyridyl and 4-carboxypyridyl.

(r) The use of compounds of formula (1), wherein B is oxygen or —NH—.

The compounds of formula (1) and the preparation thereof are disclosed, inter alia, in JP Kokai Hei 3-239757 and JP Kokai Hei 3-241069.

Cellulosic fibre materials typically include the natural cellulose fibres such as cotton, linen and hemp, as well as cellulose and regenerated cellulose. The compounds of formula (1) are also suitable for treating hydroxyl group-containing fibres that are components of fibre blends, typically blends of cotton with polyester or polyamide fibres. Preferred fibre materials are those having a density of 30 to 200 g/m$^2$. Cotton is the preferred cellulosic fibre material. The fibre materials referred to may be in different forms of presentation, including filaments or yarns or woven or knitted fabrics.

The compounds of formula (1) can be applied to the fibre material and fixed thereon by different means commonly employed in the textile industry, preferably in the form of aqueous solutions. They are suitable for pad dyeing or, preferably, for the exhaust process.

The exhaust process is carried out in the temperature range from 50° to 120° C., conveniently from 50° to 70° C., in the presence of an acid acceptor such as sodium carbonate, sodium hydrogencarbonate, sodium formate, potassium carbonate, sodium silicate, sodium trichloroacetate or sodium triphosphate, in the absence or presence of a neutral salt such as sodium sulfate or sodium chloride.

The liquor ratio in the exhaust process can be chosen over a wide range, for example from 1:3 to 1:200, preferably from 1:10 to 1:40.

The compounds of formula (1) are used in the practice of this invention typically in an amount of 0.005 to 10% by weight, preferably 0.05 to 2% by weight, based on the fibre material.

The application of the compounds of formula (1) to the fibre material can be made in a separate treatment bath or in the dyebath, before, during or after dyeing.

The treatment bath or dyebath may also contain other conventional assistants such as wetting agents, deaerators and antifoams or penetration enhancers.

The cellulosic fabrics treated with the compounds of formula (1) are distinguished by a very high sun protection factor. The sun protection factor is defined as the quotient of harmful UV radiation without sun protection and harmful UV radiation with sun protection. Accordingly, a sun protection factor is also an indicator of the permeability of the untreated fabric and the fabric treated with the hydroxybenzotriazoles used in the practice of this invention to UV radiation.

The calculation of the sun protection factor of textile materials can be made, inter alia, by the method of B. L. Diffey und J. Robson in J. Soc. Cosmet. Chem. 40, 127–133 (May/June 1989).

The invention is illustrated by the following Examples in which parts and percentages are by weight, unless otherwise indicated. The relationship of parts by weight to parts by volume is the same as that of the kilogram to the litre.

EXAMPLE 1

A 100 g sample of bleached cotton tricot is treated at 60° C. for 20 minutes in a jet dyeing machine.

The liquor contains 1 g of the compound of formula

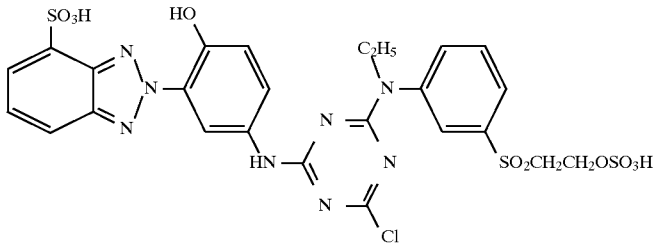

(100)

and 75 g of sodium sulfate.

To the liquor are then added 30 g of sodium carbonate and the cotton tricot is treated at 60° C. for another 60 minutes. The fabric is then removed from the liquor, washed repeatedly with cold, warm and hot water and dried.

The treated cotton tricot material has an excellent sun protection factor.

EXAMPLE 2

The procedure of Example 2 is repeated, but replacing 1 g of the compound of formula (100) with 0.75 g of the compound of formula

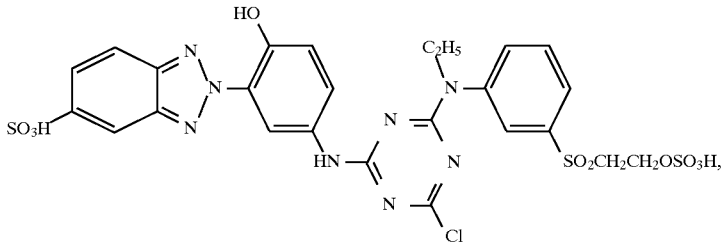

(101)

giving cotton tricot material which likewise has an excellent sun protection factor.

EXAMPLE 3

The procedure of Example 2 is repeated, but replacing the compound of formula (100) with the same amount of the compound of formula

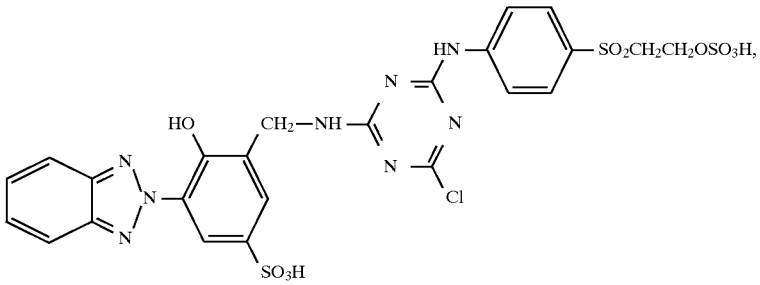

(102)

giving cotton tricot material which likewise has an excellent sun protection factor.

What is claimed is:

1. Method of use of a compound of formula

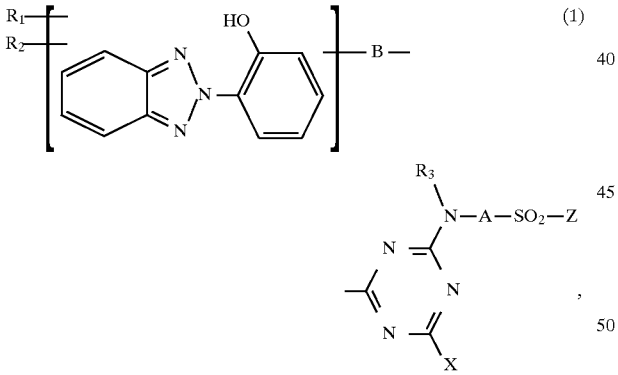

(1)

wherein $R_1$ and $R_2$ are each independently of the other hydrogen, $C_1$–$C_4$alkyl; $C_1$–$C_4$alkoxy; halogen; hydroxy; nitro; sulfo or carboxy;

$R_3$ is hydrogen; or $C_1$–$C_4$alkyl which is unsubstituted or substituted by $C_1$–$C_4$alkoxy, halogen, hydroxy, sulfo, cyano, carboxy, $C_1$–$C_4$alkoxycarbonyl, $C_1$–$C_4$alkylcarbonyloxy, carbamoyl or sulfamoyl;

A is phenylene which is unsubstituted or substituted by $C_1$–$C_4$alkyl, $C_1$–$C_4$alkoxy, halogen or sulfo; naphthylene which is unsubstituted or substituted by $C_1$–$C_4$alkyl, $C_1$–$C_4$alkoxy, halogen or sulfo, or $C_1$–$C_{12}$alkylene which is unsubstituted or substituted by halogen, hydroxy, sulfato, cyano, carboxy, $C_1$–$C_5$alkoxycarbonyl, $C_1$–$C_4$alkanoyloxy or carbamoyl, and in which the alkylene chain is interrupted from $C_2$ by oxygen or —NR'—, wherein R' is hydrogen or $C_1$–$C_6$alkyl, and may be branched from $C_3$, and R' is able to form a ring together with the alkylene chain;

B is oxygen; a radical —N($R_4$)—, wherein $R_4$ is hydrogen or $C_1$–$C_4$alkyl, or a radical —$(CH_2)_n$—NH— which is attached at the triazine radical through the nitrogen atom, and in which n is 1 to 4;

X is chloro; fluoro; pyridyl which is unsubstituted or substituted by halogen, sulfo, carboxy, carbamoyl or $C_1$–$C_4$alkyl which is unsubstituted or substituted by hydroxy or sulfo; a radical —$NR_5R_6$, wherein $R_5$ and $R_6$ are each independently of the other hydrogen, $C_1$–$C_4$alkyl which is unsubstituted or substituted by $C_1$–$C_4$alkoxy, chloro, hydroxy, sulfo, sulfato, carboxy or phenyl; phenyl which is unsubstituted or substituted by $C_1$–$C_4$alkyl, $C_1$–$C_4$alkoxy, halogen, sulfo or carboxy; naphthyl which is unsubstituted or substituted by $C_1$–$C_4$alkyl, $C_1$–$C_4$alkoxy, chloro, hydroxy, sulfo or carboxy; or benzyl which is unsubstituted or substituted in the phenyl ring by $C_1$–$C_4$alkyl, $C_1$–$C_4$alkoxy, chloro or sulfo; or a radical —$OR_7$, wherein $R_7$ is hydrogen, $C_1$–$C_4$alkyl which is unsubstituted or substituted by $C_1$–$C_4$alkoxy, chloro, hydroxy, sulfo, sulfato, carboxy or phenyl; phenyl which is unsubstituted or substituted by $C_1$–$C_4$alkyl, $C_1$–$C_4$alkoxy, halogen, sulfo or carboxy; naphthyl which is unsubstituted or substituted by $C_1$–$C_4$alkyl, $C_1$–$C_4$alkoxy, chloro, hydroxy, sulfo or carboxy; or benzyl which is unsubstituted or substituted in the phenyl ring by $C_1$–$C_4$alkyl, $C_1$–$C_4$alkoxy, chloro or sulfo; and Z is β-haloethyl, β-sulfatoethyl, β-thiosulfatoethyl, β-phosphatoethyl, β-acetoxyethyl or vinyl;

for enhancing the sun protection factor of cellulosic fabrics, which method comprises treating cellulosic fabrics with compound of formula (1).

2. Method of use of a compound of formula (1) according to claim 1, wherein $R_1$ is hydrogen, methyl, ethyl, propyl, isopropyl, methoxy, ethoxy, chloro, hydroxy, sulfo or carboxy.

3. Method of use of a compound of formula (1) according to claim 1, wherein $R_2$ is hydrogen, methyl, ethyl, propyl, isopropyl, methoxy, ethoxy, chloro, hydroxy, sulfo or carboxy.

4. Method of use of a compound of formula (1) according to claim 1, wherein X is the radical —$NR_5R_6$, wherein $R_5$ and $R_6$ are each independently of the other hydrogen; $C_1$–$C_4$alkyl which is unsubstituted or substituted by $C_1$–$C_4$alkoxy, chloro, hydroxy, sulfo, sulfato, carboxy or phenyl; phenyl which is unsubstituted or substituted by $C_1$–$C_4$alkyl, $C_1$–$C_4$alkoxy, halogen, sulfo or carboxy; naphthyl which is unsubstituted or substituted by $C_1$–$C_4$alkyl, $C_1$–$C_4$alkoxy, chloro, hydroxy, sulfo or carboxy; or benzyl which is unsubstituted or substituted in the phenyl ring by $C_1$–$C_4$alkyl, $C_1$–$C_4$alkoxy, chloro or sulfo.

5. Method of use according to claim 4, wherein $R_5$ is hydrogen, methyl, ethyl, propyl, isopropyl, butyl, isobutyl, sec-butyl, β-methoxyethyl, β-hydroxyethyl, β-sulfoethyl, β-sulfatoethyl or β-carboxyethyl.

6. Method of use according to claim 4, wherein $R_6$ is hydrogen, methyl, ethyl, propyl, isopropyl, butyl, isobutyl, sec-butyl, β-methoxyethyl, β-hydroxyethyl, β-sulfoethyl, β-sulfatoethyl or β-carboxyethyl.

7. Method of use according to claim 4, wherein $R_5$ is phenyl, 2-sulfophenyl, 3-sulfophenyl, 4-sulfophenyl, 2,4-disulfophenyl, 2,5-disulfophenyl, 2-carboxyphenyl, 3-carboxyphenyl or 4-carboxyphenyl.

8. Method of use according to claim 4, wherein $R_6$ is phenyl, 2-sulfophenyl, 3-sulfophenyl, 4-sulfophenyl, 2,4-disulfophenyl, 2,5-disulfophenyl, 2-carboxyphenyl, 3-carboxyphenyl or 4-carboxyphenyl.

9. Method of use according to claim 4, wherein $R_5$ is 2-sulfo-1-naphthyl, 3-sulfo-1-naphthyl, 4-sulfo-1-naphthyl, 5-sulfo-1-naphthyl, 6-sulfo-1-naphthyl, 7-sulfo-1-naphthyl, 8-sulfo-1-naphthyl, 1-sulfo-2-naphthyl, 5-sulfo-2-naphthyl, 6-sulfo-2-naphthyl, 7-sulfo-2-naphthyl, 8-sulfo-2-naphthyl, 1,5-disulfo-2-naphthyl, 5,7-disulfo-2-naphthyl, 6,8-disulfo-2-naphthyl, 4,8-disulfo-2-naphthyl, 4,7-disulfo-2-naphthyl, 3,8-disulfo-2-naphthyl, 4,6-disulfo-2-naphthyl, 3,7-disulfo-2-naphthyl, 3,6-disulfo-2-naphthyl, 4,6,8-trisulfo-1-naphthyl, 2,4,7-trisulfo-1-naphthyl, 3,6,8-trisulfo-1-naphthyl, 4,6,8-trisulfo-2-naphthyl, 1,5,7-trisulfo-2-naphthyl or 3,6,8-trisulfo-2-naphthyl.

10. Method of use according to claim 4, wherein $R_6$ is 2-sulfo-1-naphthyl, 3-sulfo-1-naphthyl, 4-sulfo-1-naphthyl, 5-sulfo-1-naphthyl, 6-sulfo-1-naphthyl, 7-sulfo-1-naphthyl, 8-sulfo-1-naphthyl, 1-sulfo-2-naphthyl, 5-sulfo-2-naphthyl, 6-sulfo-2-naphthyl, 7-sulfo-2-naphthyl, 8-sulfo-2-naphthyl, 1,5-disulfo-2-naphthyl, 5,7-disulfo-2-naphthyl, 6,8-disulfo-2-naphthyl, 4,8-disulfo-2-naphthyl, 4,7-disulfo-2-naphthyl, 3,8-disulfo-2-naphthyl, 4,6-disulfo-2-naphthyl, 3,7-disulfo-2-naphthyl, 3,6-disulfo-2-naphthyl, 4,6,8-trisulfo-1-naphthyl, 2,4,7-trisulfo-1-naphthyl, 3,6,8-trisulfo-1-naphthyl, 4,6,8-trisulfo-2-naphthyl, 1,5,7-trisulfo-2-naphthyl or 3,6,8-trisulfo-2-naphthyl.

11. Method of use according to claim 4, wherein $R_5$ is benzyl, 2-sulfobenzyl, 3-sulfobenzyl or 4-sulfobenzyl.

12. Method of use according to claim 4, wherein $R_6$ is benzyl, 2-sulfobenzyl, 3-sulfobenzyl or 4-sulfobenzyl.

13. Method of use according to claim 4, wherein one of the substituents $R_5$ and $R_6$ is $C_1$–$C_4$alkyl which is unsubstituted or substituted by $C_1$–$C_4$alkoxy, chloro, hydroxy, sulfo, sulfato, carboxy or phenyl; phenyl which is unsubstituted or substituted by $C_1$–$C_4$alkyl, $C_1$–$C_4$alkoxy, halogen, sulfo or carboxy; naphthyl which is unsubstituted or substituted by $C_1$–$C_4$alkyl, $C_1$–$C_4$alkoxy, chloro, hydroxy, sulfo or carboxy; or benzyl which is unsubstituted or substituted in the phenyl ring $C_1$–$C_4$alkyl, $C_1$–$C_4$alkoxy, chloro or sulfo, and the other substituent $R_5$ or $R_6$ is hydrogen, methyl or ethyl.

14. Method of use of a compound of formula (1) according to claim 1, wherein A is phenylene which is unsubstituted or substituted by $C_1$–$C_4$alkyl, $C_1$–$C_4$alkoxy, halogen or sulfo.

15. Method of use of a compound of formula (1) according to claim 1, wherein A is the group —$(CH_2)_a$—NH—$(CH_2)_b$—, wherein a is an integer from 1 to 6 and b is an integer from 1 to 6.

16. Method of use of a compound of formula (1) according to claim 1, wherein Z is the radical —$CH_2CH_2OSO_3H$.

17. Method of use of a compound of formula (1) according to claim 1, wherein X is pyridyl, 3-methylpyridyl, 3-β-hydroxyethylpyridyl, 4-β-sulfoethylpyridyl, 4-chloropyridyl, 3-sulfopyridyl, 2-carboxypyridyl, 3,5-dicarboxypyridyl or 2-carbamoylpyridyl, 3-carbamoylpyridyl, or 4-carbamoylpyridyl, preferably 3-carboxypyridyl and 4-carboxypyridyl.

18. Method of use of a compound of formula (1) according to claim 1, wherein B is oxygen or —NH—.

19. Method of use of a compound of formula (1) according to claim 1, wherein $R_1$ is hydrogen or sulfo, $R_2$ is hydrogen, $R_3$ is hydrogen or ethyl, A is phenyl, B is —NH— or —$CH_2$—NH—, is X is chloro, A is a direct bond and Z is the radical —$CH_2CH_2OSO_3H$.

20. Method of use according to claim 1, wherein the cellulosic fibre material is cotton.

21. Method of use of a compound of formula (I) according to claim 1, wherein X is 3-carboxypyridyl or 4-carboxypyridyl.

* * * * *

UNITED STATES PATENT AND TRADEMARK OFFICE

CERTIFICATE OF CORRECTION

PATENT NO. : 5,811,081

DATED : September 22, 1998

INVENTOR(S) : Francesco Fuso, et. al.

It is certified that error appears in the above-identified patent and that said Letters Patent is hereby corrected as shown below:

Title page, left column, insert section [30], it should read:

-- Foreign Applications Priority Data

Sept. 29, 1994 [CH] Switzerland 2952/94-1 --.

Signed and Sealed this

Ninth Day of February, 1999

*Attest:*

*Attesting Officer*

*Acting Commissioner of Patents and Trademarks*